United States Patent [19]

Pöll

[11] 4,052,863

[45] Oct. 11, 1977

[54] MULTIPLE GEM SETTING HAVING A COMPONENT OF GEMS SET IN FUSION ADHESIVE FOIL

[75] Inventor: Martin Pöll, Fritzens, Austria

[73] Assignee: D. Swarovski & Co., Wattens-Triol, Austria

[21] Appl. No.: 628,665

[22] Filed: Nov. 4, 1975

[30] Foreign Application Priority Data

Nov. 4, 1974 Germany ..... 2452250

[51] Int. Cl.[2] ..... A44C 17/02

[52] U.S. Cl. ..... 63/28; 156/298; 156/309; 428/67

[58] Field of Search ..... 63/28, 26; 428/67, 125; 156/298, 309

[56] References Cited

U.S. PATENT DOCUMENTS

| | | | |
|---|---|---|---|
| 1,706,766 | 3/1929 | Auld et al. | 428/67 |
| 2,014,414 | 9/1935 | Schneeweis | 156/298 |
| 2,425,933 | 8/1947 | Gregory | 428/67 |
| 2,569,398 | 9/1951 | Burd et al. | 63/DIG. 3 |
| 2,596,965 | 5/1952 | Troy | 156/298 |

*Primary Examiner*—F. Barry Shay

*Attorney, Agent, or Firm*—Birch, Stewart, Kolasch and Birch

[57] ABSTRACT

A component comprising a plurality of gemstones containing visible faces and seating faces, said gemstones being mounted by their seating faces in a given arrangement and with a given mutual spacing therebetween in respective recesses in a support, said support being a continuous foil of fusion adhesive. The component is made in an apparatus that includes a plate with a heating chamber on one side and a vacuum chamber on the other. The stones are arranged in recesses on the plate with their seating faces outward, a sheet of adhesive foil (transparent or colored) is positioned thereover, heated into a thermoplastic state and drawn down by vacuum to surround and adhere to the seating faces. The component (foil with stones affixed) is then placed in a recessed jewelry setting with each stone in a recess, and again heated to fuse the foil to the setting.

18 Claims, 5 Drawing Figures

MULTIPLE GEM SETTING HAVING A COMPONENT OF GEMS SET IN FUSION ADHESIVE FOIL

BACKGROUND AND SUMMARY OF THE INVENTION

The present invention relates to a gemstone composite comprising a plurality of gemstones which are affixed by their seating faces in a given arrangement and with a given mutual spacing with a support material. The present invention further relates to a process for producing components comprising inset gemstones, said gemstones being disposed in a given arrangement and provided with a mutual spacing therebetween and disposed in a plane such that their visible faces all lie on one side of the plane and their seating faces lie on the other side of said plane, said faces being bonded to a support. The present invention is also directed to an apparatus for effecting the above composite comprising a screening or perforated plate which is mounted in a frame and provided with recesses for receiving the visible faces of the gemstones.

Components comprising inset gemstones are known wherein the gemstones are glued onto a grid-type support consisting of rings connected together by webs. The diameter of the rings is selected in such a way that the stones are secured by their seating faces in the rings but they do not fall through the rings. These known gemstone components are flexible and can be divided according to specific patterns. However, they are complicated to produce, particularly when gems of different dimensions are to be inset in one component, as the diameter of the rings in the grid-type support must then be adapted to the dimensions of the gems. Another problem exists in that the adhesive, which is used to secure the component comprising the inset gemstones, to the mounting or backing, must not interfere with or impair the adhesive which is used to secure the gemstones on the grid-type support.

A process for producing gemstones comprising a seating face coated with a fusion adhesive and a non-coated visible (effect) face, said seating faces being engaged in a support or a setting, is also well known. According to this process, a spot of fusion adhesive is placed on the seating face of each individual gemstone. The adhesive can also be in the form of a small cap individually pressed and punched out of a plastic foil. Its shape is matched to that of the bottom of the gemstone, that is, to the seating face, which it covers. These caps can also be produced by extruding corresponding shapes and subsequently drying the same. In the case of this known process, the operation of providing the individual gemstones with an adhesive layer is complicated and costly due to the single-part production thereof. Costly devices are thus required to render the operation more economical by simultaneously applying an adhesive coating to the seating face of a plurality of gemstones. It is not as costly in terms of apparatus to produce the adhesive caps by extrusion and subsequent drying as compared to pressing and punching them out of a plastic foil, but irregularities tend to occur in the thickness of the adhesive layer and it is very difficult to precisely define the adhesive layer with respect to the visible surface of the stone. Stones which have been coated with adhesive according to this process require a considerable amount of manual work when they are set into the mounting or setting, thus giving rise to high costs of stone mounting.

An object of the present invention is to produce components comprising inset gemstones of the type previsouly described which can be produced inexpensively, more simply and more rapidly than the known components comprising inset gemstones. These components also enable the gemstones to be mounted in their settings more rapidly, more simply, and more durably with greater precision and while retaining their full brilliance. The coating of fusion adhesive on the seating face of the gemstones in the component should be regular and should completely grip the seating face while ensuring sharper definition with respect to the visible face. The new gemstone inlaid component should be prepared with a minimum amount of additional material which is aesthetically unpleasing and results in unnecessary costs.

Another object of the present invention is to provide a process for producing gemstone inlaid components of the type which enables them to be mass produced, both rapidly and accurately, and discontinuously or continuously, using a simple, reliable and inexpensive apparatus. The present invention is also directed to a device for effecting the process of the present invention.

Other objects and further scope of applicability of the present invention will become apparent from the detailed description given hereinafter; it should be understood, however, that the detailed description and specific examples, while indicating preferred embodiments of the invention, are given by way of illustration only, since various changes and modifications within the spirit and scope of the invention will become apparent to those skilled in the art from this detailed description. Pursuant to the present invention, the above-mentioned problems are eliminated by providing a component comprising inset gemstones and a support wherein a plurality of stones are affixed by their seating faces to said support in a given arrangement and with a given mutual spacing. The support is a continuous foil of fusion adhesive, possibly receiving the gemstones in relief, while simultaneously forming the adhesive.

The present invention also relates to a process for producing components inset with gemstones wherein the stones are disposed in a given arrangement with a given mutual spacing and in a plane in such a way that their visible faces are all disposed on one side of said plane and their seating faces are disposed on the other side of said plane. The seating faces are glued to the support or foil of fusion adhesive by stretching the adhesive over the stones substantially parallel to said plane and at a distance from the seating faces. The foil is converted into its thermoplastic state by the application of heat and is then molded to the shape of all the seating faces by producing a differential pressure on the two sides of said plane. The shaped foil is further heated until it adheres to the seating faces and the foil and stones are then cooled to room temperature.

The present invention also relates to a device for effecting the process wherein a screen or perforated plate which is mounted in a frame contains recesses for receiving the visible faces of the gemstones. The frame is open at its upper portion and is divided into an upper and a lower portion by a plane which is approximately parallel to the perforated plate and is disposed at the dividing edges between the upper and lower portions. Clamping devices are disposed at said dividing edges for receiving the foil of fusion adhesive. The perforated plate is disposed in the lower portion of the frame at a distance above the base of the frame so as to form a suction chamber, said recesses communicating with said suction chamber via bore holes.

The present invention is also directed to a piece of jewelery comprising a gemstone setting with stones mounted thereon. The stones comprise a visible or effect surface and a seating face which is inserted in the recess of the setting. The gemstones are connected to the setting by means of a fusion adhesive which consists of a continuous layer.

In the case of new components inset with gemstones according to the present invention, the seating faces of the gemstones are completely and regularly coated with a layer of fusion adhesive of uniform thickness which is precisely defined with respect to the visible faces of the stones. The foil connecting the stones holds them in the desired arrangement for the final product. The foil has another advantage in that the entire group of stones in a particular pattern can be handled as a unit both up to and during processing of the end product. As a result, when using the components, that is, when mounting the stones on the setting, a reduction in time of $\frac{7}{8}$ of that time required for setting conventional stones coated with adhesive is obtained. For examples, it takes approximately 4 minutes using conventional gemstones to fill a setting 45 × 22 mm with PP 13 chatons (corresponds to 200 stones). Using the method and device of the present invention, it is possible to mount the stones in approximately 30 seconds. As the stones must be mounted manually, the stone setting costs are also reduced to $\frac{1}{8}$ of the setting costs of conventional gemstones.

The new components of the present invention also possess extremely good adhesive values with all types of stone and ensure an extremely clean joint which enables the stones to retain their full brilliance.

The components according to the present invention can be produced, more rapidly, more simply, and less expensively than the conventional components and the grid-type support is eliminated. This improves the aesthetic appearance of the finished piece of jewelry. The new components can also be divided more easily and less obviously and gemstones can be arranged on the components in any desired density.

In the case of the components according to the present invention, the gemstones can be grouped in a round, oval, or ornamental arrangement. It is not necessary to precisely arrange the stones when they are used. If the adhesive foil is transparent, when using a refined or galvanized setting, the faces between the stones remain completely visible and thus are important. However, the foil of fusion adhesive can also be colored. In this event, the setting does not need to be refined as the appearance of the piece is determined by the color of the foil.

According to one embodiment of the component according to the present invention, it is possible to achieve an additional effect. The claw setting, common to stamped parts, is frequently imitated in the case of cast gemstone settings by providing a relief in the surface of the cast part, that is, imitation mounting claws are integrally cast between the stone settings, that is, between the recesses for the seating faces of the stones to be mounted. An advantage of this particular embodiment is that it is possible to provide raised portions on the surface of the gemstone setting, during casting, and to accurately adapt the shape of the cutout sections of the foil of fusion adhesive connecting the gemstones, to these raised protions, such that the gemstones and the setting interlock during adhesion in a manner similar to a press fastener, thereby reinforcing the attachment of the gemstones to the support or setting.

A particularly advantageous method of employing the new components comprises fusing the components, with the coated seating faces of the gemstones disposed in corresponding recesses of the setting or support, together with the setting or mounting in a tempering or malleableizing oven at the fusion temperature of the foil and the setting, and then cooling the finished piece. This ensures sufficient heating of the adhesive foil at all portions of the gemstone bond.

If a heatable setting is used, more particularly, a metal setting, the gemstones can be more successfully employed by preheating the setting to the fusion temperature of the foil before mounting the components or the gemstones. The stones are then mounted on the hot setting and fusion adhesion takes place. The piece is then cooled. In this embodiment, the stones per se are not brought to the full oven temperature. Neither of the modes of employing the new components are critical for the gemstones in terms of temperature. The temperature which is utilized in the present process is that temperature which is necessary to bring the adhesive foil to a thermoplastic state. This, of course, depends upon the type of adhesive foil which is utilized. The adhesive foil utilized in the present invention reaches a thermoplastic state above about 80° C, preferably between about 100°-200° C.

The process according to the present invention for producing the new gemstone inlaid components is characterized by its extreme simplicity and very rapid rate of production. It enables the adhesive foil to be fused on the seating faces of the gemstones in a very rapid and simple manner. The application of the foil is also very regular and the foil does not adhere anywhere else. Particularly sharp definition between the coated faces (seating faces) of the gemstones and the non-coated faces (visible or effect faces) is also obtained. Due to the fact that the foil is rendered malleable and is applied against the seating faces of the gemstones by means of a vacuum, no bubbles are trapped between the foil and the seating faces of the stones, thereby ensuring a good bond between the stones and the foil. By stretching the foil slightly, that is, by stretching out the foil until all folds have been eliminated, it is possible to avoid any accumulation of the fusion adhesive over and above the amount required, either on or between the gemstones, which would normally be produced as a result of fold formation or the like. If the visible faces of the gemstones are covered during fusion of the adhesive foil, it is practically impossible to soil or deposit adhesive on these visible surfaces and thus the stones retain their full brilliance.

The process of the present invention has another advantage in that the foil does not necessarily have to be arranged in a horizontal plane, although this is the most common procedure in the case of intermittent operation. Thus, it is also possible to arrange the stones in a simple or multiple curved plane which enables the finished component to more easily conform to such a curved plane in the case of very large pieces of jewelery.

The process can be carried out discontinuously or continuously. In the latter case, the stones are arranged in a continuously advanced plane and the foil is supplied, for example, in the form of a web, from a roller. The continuously advanced plane may be straight, for example, a perforated plate belt, or preferably can be in the form of a cylindrical surface which rotates about the axis of a cylinder. In the case of a continuous operation, radiation heat is preferably used to heat the foil during the fusion step. This enables the process step of heating the foil and rendering it malleable to be effected with a minimum expenditure for machinery.

The process advantageously contains a further step which takes place after the foil has cooled. This step consists in separating or cutting or stamping out sections of the foil between the gemstones. In this way, the step of imitating setting claws is transferred from the process for producing the setting or mounting to the process for producing the component, thereby simplifying operations and reducing the production costs of the jewelry.

The process of the present invention enables the gemstones to be arranged and oriented with respect to one another according to any given design. If the stones are to be uniformly distributed, a long, possibly endless, component web can be divided into the desired gemstone groupings. If a round, oval or ornamental arrangement or orientation of the gemstones, or some other pattern is selected, this can also be easily cut from the foil.

The appearance of the type of adhesive foil which is selected for the process of the present invention also makes it possible to reduce the final processing stages or finish work involved in the production of gemstone settings or mountings.

The plane in which the stones are arranged according to the present invention obviously does not have to be completely constant but can also have different forms.

The apparatus for effecting the process according to the present invention is characterized by its simple design and reliability of operation. The perforated plate or the frame holding the perforated plate can be so constructed that it can be displaced in the horizontal direction by oscillating movements to enable the gemstones to be automatically inserted by their visible faces in the recesses of the perforated plate. The entire frame can be designed as a horizontally pivoting frame without excessive constructional expenditure since the connection to the suction nozzles for the suction chamber can remain flexible and the heating device in the form of heat-radiating elements does not require a mechanical connection with the frame, that is, a mechanically flexible coupling for attaching the heat-radiating elements to said frame. The division of the frame into an upper and lower portion represents a constructurally simple system for providing clamping devices for holding the adhesive foil over the gemstones. In addition, the lower part of the frame is more readily accessible. The dividing plane is preferably disposed in a position where it just touches the highest points of the seating faces of the gemstones disposed in the recesses of the perforated plate. This ensures that the foil is accurately fused onto the seating faces of the gemstones and is regularly distributed over the seating faces when a vacuum is applied from the visible side of the stones disposed in the recesses of the perforated plate.

By providing separating layers at the dividing edges of the apparatus, the adhesive foil is prevented from being fused onto the gemstones between the upper portion of the frame and the lower portion during the heating operation. The same effect could be obtained in a slightly more complicated manner by cooling the upper and lower portions of the frame at their dividing edges.

The special embodiment of the apparatus of the present invention which enables the process to be carried out in a continuous manner has a very simple construction and thus can be produced inexpensively and operates accurately and reliably.

The use of the new component gemstone of the present invention results in a piece of jewelry which is not only less expensive than jewelry produced with the conventional components or with individual gemstones, but it is also more durable and its appearance is at least comparable to and in some ways superior to that of jewelry produced with conventional components or individual gemstones.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
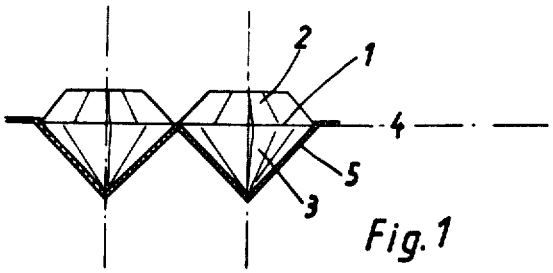
FIG. 1 represents a detail of a vertical section through gemstone inlaid components according to the present invention wherein only two stones are represented and the others have been removed to simplify the drawing.
Figure 3:
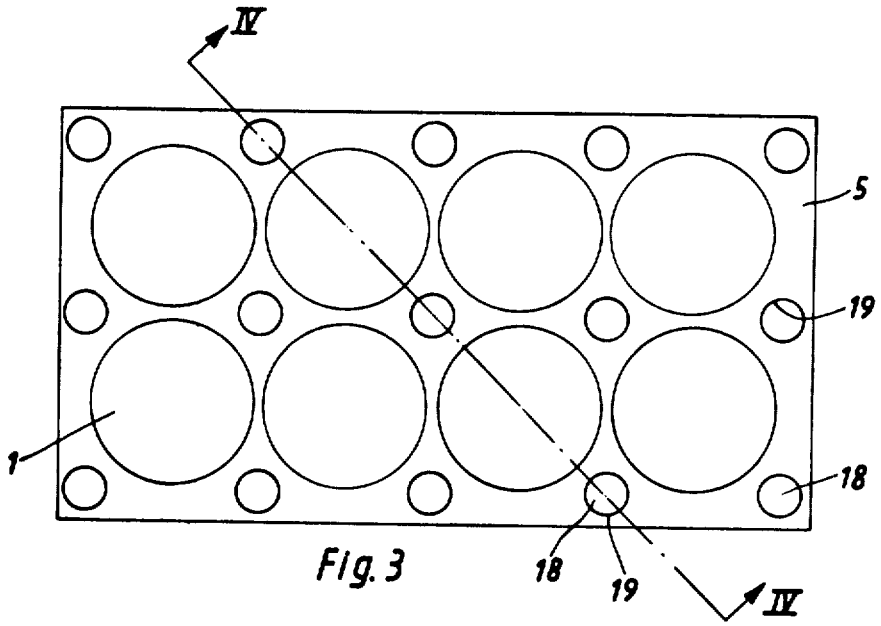
FIG. 3 is a plan view of another embodiment of the gemstone inlaid components according to the present invention mounted in a setting.
Figure 4:
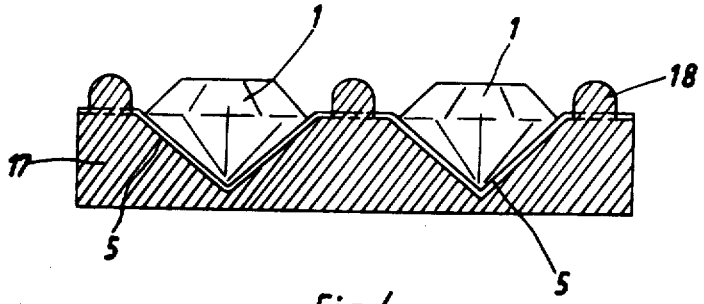
FIG. 4 is a section taken along line IV—IV of FIG. 3.

In FIG. 1, reference numeral 1 designates a gemstone which comprises a visible or effect face 2 which remains free when the stone 1 is mounted in a setting, and a seating face 3 which is coated with a fusion adhesive. All of the facets of the seating face 3 are enclosed in the fused-on adhesive foil 5. The application of the foil is so accurate that the plane 4 in which the gemstones 1 are disposed and which divides the visible faces 2 from the seating faces 3 constitutes the precise limit of the adhesive foil 5. The combination of the gemstones 1 and the adhesive foil 5 is known as the component. FIGS. 3 and 4 show a plurality of components which have already been mounted in a setting for achieving special effects.

In the case of cast gemstone settings 17, the claw form common to stamped elements is frequently imitated by utilizing corresponding relief portions 18 of the surface of the cast element 17. Thus, mounting claws are integrally cast, as an imitative measure, between the respective stone settings, that is, between the recesses in which the seating faces of the stones 1 are to be inserted. Another advantage of the embodiment is that it is still possible to provide raised portion 18 on the surface of the gemstone setting 17 during casting and to accurately adapt the shape of the cutout sections 19 of the adhesive foil 5 connecting the gemstones 1, to these raised portions 18, such that the foil and the setting 17 interlock in the manner of a press fastener during adhesion, thereby reinforcing the attachment of the component on the setting 17. The coated seating faces 3 of the gemstones 1 are then inserted in corresponding recesses in the setting to produce a piece of jewelery. After being mounted in the setting, they are fused together with the setting by the application of heat.

Figure 2:
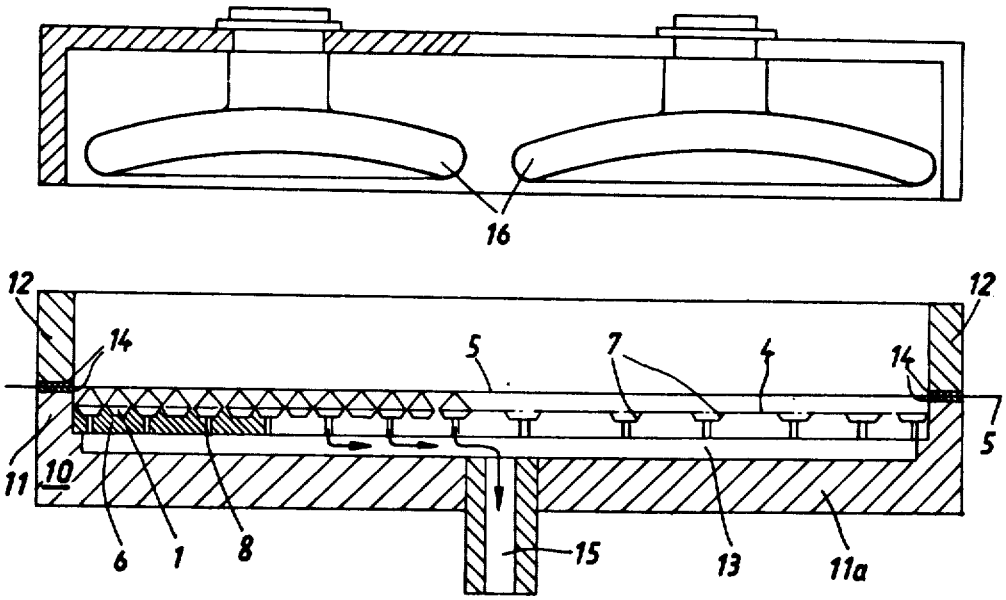
FIG. 2 is a vertical section through an embodiment of the apparatus for effecting the process in a discontinuous manner; the dot-dash dash lines indicate a variant for effecting a continuous process.

FIG. 2 shows the apparatus for implementing the process for producing the components represented in FIG. 1. It consists of a frame 10 comprising an upper portion 12 and a lower portion 11. The lower portion 11 includes a base 11*a*. A perforated plate 6 supported by projections on the inner side of the lower portion 11 of the frame is mounted in the frame 12. The plate 6 is mounted in such a way as to define a suction chamber 13 between the base 11*a* of the frame and the bottom of the perforated plate. In the embodiment represented, the upper side of the perforated plate 6 is in alignment with the plane 4, said plane dividing the visible faces 2 and the seating faces 3 of the gemstones 1. The upper side of the perforated plate 6 contains recesses 7 for receiving the visible faces 2 of the gemstones. These recesses possess a given orientation with respect to one another, that is, they are disposed according to a given pattern or spacing arrangement and their shape exactly corresponds to the shape of the visible faces 2. Bore holes lead from the bottom of these recesses 7 through the perforated plate 6 to the suction chamber 13. A suction nozzle 15 passing through the frame base 11*a* connects the suction chamber 13 to a vacuum pump (not shown). The upper portion of the frame 12 and the lower portion of the frame 11 are divided along a horizontal plane and their dividing edges are covered by a dividing layer 14. The adhesive foil 5 is clamped between these dividing edges or their dividing layers 14 and its vertical disposition is such that it just touches the tips of the seating faces 3 of the gemstones 1 which are mounted by their visible faces 2 in the recesses 7 of the perforated plate 6. Heat radiating elements 16 which irradiate the fusion foil 5 are disposed above the frame 10, which is open at its top portion.

To produce the component of FIG. 1 according to the present invention, a large number of gemstones are placed on the perforated plate 6, followed by horizontal shaking. In the course thereof, the gemstones fall into the recesses 7, generally with the visible face 2 facing in the downward direction because the center of gravity of the gemstone is located close to the visible face 2. The gemstones remain in this position, supported on the edges of the recesses 7. Any gemstones which are disposed in the recesses in a different position are removed from their incorrect position by horizontally displacing the stone above them. This is possible due to the fact that in this position they have a high center of gravity and they are not supported on all sides by the edges of the recesses. After all of the recesses 7 have been filled with gemstones 1, the perforated plate 6 is inserted in the frame 10 by placing it in the lower portion 11 of the frame while the upper portion of the frame is removed.

A foil of adhesive 5 is then placed on the dividing layers 14 at the dividing edges. It is spread out and stretched in a smooth manner above the gemstones. The upper portion 12 of the frame is then replaced.

The heat-radiating elements 16 are now switched on and the adhesive foil is heated. It reaches the thermoplastic state above a temperature of about 80° C. It lies as a flat surface above the stones and seals, with the upper portion 12 of the frame, the space between the perforated plate 6, the side portions of the lower portion 11 of the frame, and the adhesive foil itself. Air is now drawn from this chamber via the suction nozzle 15 through the bores 8 provided in the perforated plate 6. The air follows the path which is diagrammatically illustrated by the arrows in some of the bores 8. Upon reaching the thermoplastic state, the foil 5 is molded to the shape of the gemstones 1 by the action of the external air pressure pressing upon it. By heating for a few more seconds, complete adhesion with the stones is achieved. The effect face or visible face 2 of the stones 1 is completely untouched by the adhesive foil 5. The foil is also prevented from sticking to the perforated plate 6 bearing the gemstones.

When the foil has been molded to the shape of the gemstones, the heat and suction pressure are discontinued. The upper portion 12 of the frame can then be removed and the finished foil 5 and the gemstones 1 coated with the foil can be removed as a single component.

Figure 5:
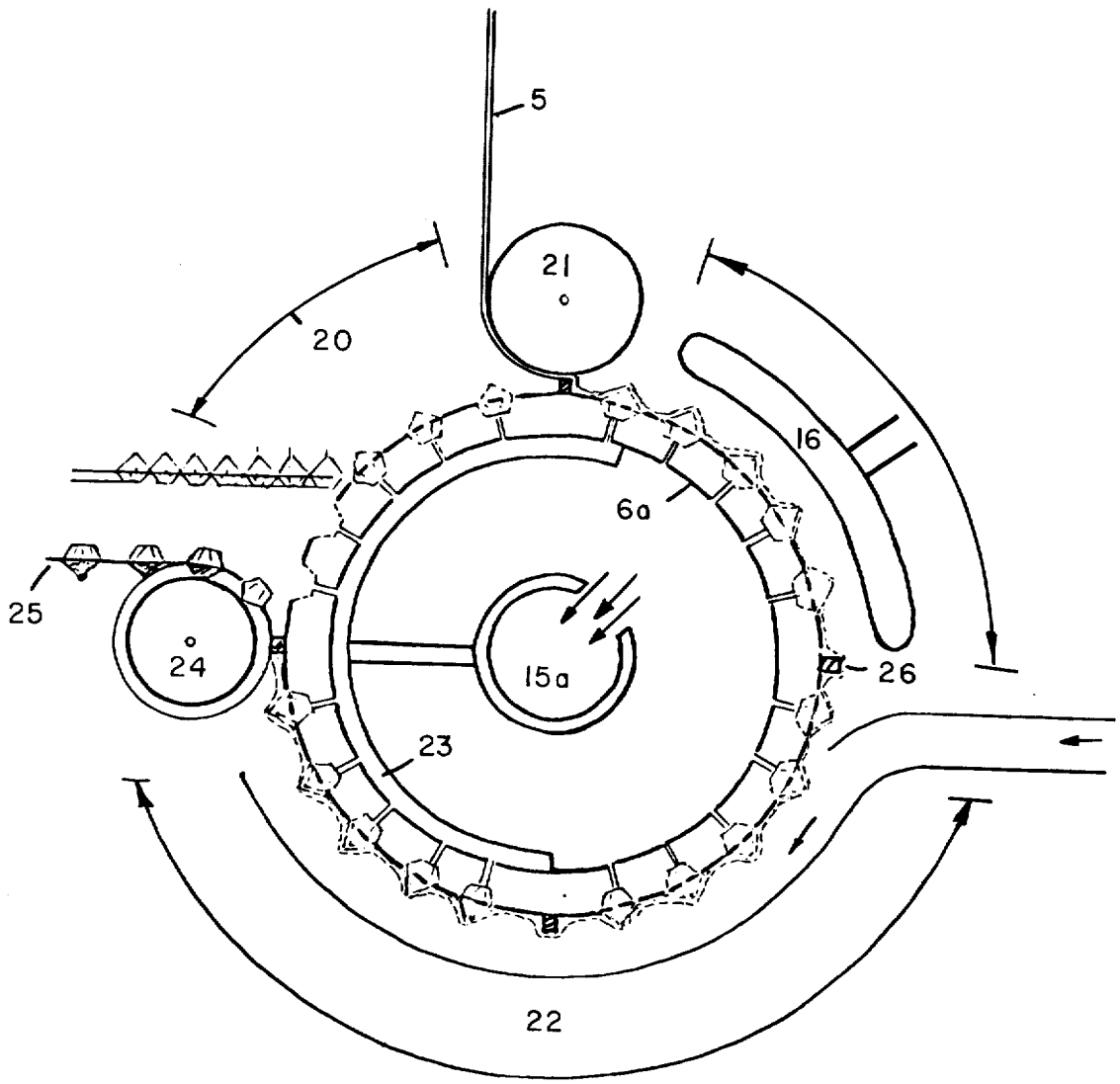
FIG. 5 shows a continuously working embodiment.

To enable the process to be carried out continuously, the apparatus shown in FIG. 5 may be used. In this embodiment, the perforated plate is in the form of a perforated cylinder 6*a*. The front sides of the cylinder are closed by the side portions of the lower frame portion. The bottom of the frame shown in the embodiment of FIG. 2 is not present and thus the entire inner chamber of this hollow cylinder forms a suction chamber. The nozzle 15*a* corresponding to the suction nozzle 15 of FIG. 2 is advantageous concentrically mounted with respect to the axis of the perforated cylinder in one of the front sides. With the continuously working embodiment of FIG. 5 in the area 20 the stones are applied on the cylinder 6*a* where they are fastened in the corresponding recesses 7 by a slight vacuum. The foil of adhesive 5 is supplied by a roll 21 and in the area of the heating element 16 the foil is plasticized and molded to the shape of the gemstones 1 by the action of the vacuum. In the subsequent area 22 the product is chilled and the finished band set by the gemstones 25 is discharged by take-off roll 24. In the area of the take-off roll 24 the suction action is prevented by a fixed seal 23 sliding on the cylinder 6*a*. During processing bigger gemstones having a diameter of more than about 2 mm it is advantageous to place sealing profiles 26 on the surface of the cylinder 6*a*. These sealing profiles extend axially and they are as high as the peripheral edges of the front sides of the perforated cylinder. In this embodiment rollers are provided as pressure rollers or counter-rollers to press or clamp the foil 5 on the peripheral edges of the front sides of the perforated cylinder 6. The peripheral edges of the rollers can be provided with dividing layers 14 in the same way as the front sides of the perforated cylinder 6. In this embodiment of the apparatus, the foil 5 is supplied as an endless web. The finished component inlaid with gemstones can also be removed as an endless web and can be divided in an appropriate or desired manner after removal. Useful are polyamide foils plasticizable between 80° and 200° C.

By virtue of this advantageous method of producing components inlaid with gemstones, the cost of components produces results in a substantial reduction in the cost of producing jewelry. An additional advantage is that the stone-setting capacity of firms producing jewelry can be increased without increasing the number of employees.

Components inlaid with gemstones are used in jewelry, embroidery and as decoration for clothing and shoes.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

It is claimed:

1. A component comprising a plurality of gemstones containing visible faces and seating faces, said gemstones being mounted by their seating faces in a given arrangement and with a given mutual spacing therebetween in respective recesses in a support, said support being a continuous foil of fusion adhesive.

2. The component of claim 1, wherein regions of the support between the gemstones are cut-out for receiving imitation mounting claws.

3. The component of claim 1, wherein the continuous foil of fusion adhesive is transparent.

4. The component of claim 1, wherein the continuous foil of fusion adhesive is colored.

5. The component of claim 1, wherein the continuous foil of fusion adhesive reaches a thermoplastic state above about 80° C.

6. The component of claim 1, wherein the adhesive foil reaches a thermoplastic state between about 100°-200° C.

7. The component of claim 1, wherein the foil of fusion adhesive is a polyamide foil which reaches a thermoplastic state between 80° and 200° C.

8. The item of jewelry of claim 1, wherein the seating faces do not lie in the same plane.

9. An item of jewelry comprising a setting having a surface including a plurality of recessed surface areas and a component comprising a plurality of gemstones containing visible faces and seating faces said gemstones being mounted by their seating faces in a given arrangement and with a given mutual spacing therebetween in a continuous foil of fusion adhesive, said component being mounted to said surface with said gemstones in respective ones of said recessed surface areas of the setting, said gemstones being bonded to said surface, the bond being provided by said foil of fusion adhesive as a continous layer.

10. The item of jewelery of claim 9, wherein cut-out sections are provided in the foil of fusion adhesive in the region between the gemstones.

11. The item auxiliary of claim 9, wherein the foil of fusion adhesive is transparent.

12. The item of jewelry of claim 9, wherein the foil of fusion adhesive is colored.

13. The item of jewelry of claim 9, wherein imitation mounting claws are integrally disposed on said setting between said recessed surface areas.

14. The item of jewelry of claim 9, wherein raised portions are provided on the surface of the setting.

15. The item of jewelry of claim 9, wherein the continuous foil of fusion adhesive reaches a thermoplastic state above about 80° C.

16. The item of jewelry of claim 9, wherein the continuous foil of fusion adhesive reaches a thermoplastic state between 100° and 200° C.

17. The item of jewelry of claim 9, wherein the continuous foil of fusion adhesive is a polyamide which reaches a thermoplastic state between 80° and 200° C.

18. The item of jewelry of claim 9, wherein the seating faces do not lie in the same plane.

* * * * *